US007886641B2

(12) United States Patent
Wirth, Jr. et al.

(10) Patent No.: US 7,886,641 B2
(45) Date of Patent: Feb. 15, 2011

(54) PUSH BLOCK HAVING RETRACTABLE HEEL

(75) Inventors: John Wirth, Jr., Dubois, WY (US); Jay L. Sanger, Casper, WY (US); Paul Brutsman, Casper, WY (US); Dan Stoops, Casper, WY (US)

(73) Assignee: Woodworker'S Supply Inc., Casper, WY (US)

( * ) Notice: Subject to any disclaimer, the term of this patent is extended or adjusted under 35 U.S.C. 154(b) by 1147 days.

(21) Appl. No.: 10/696,587

(22) Filed: Oct. 30, 2003

(65) Prior Publication Data

US 2005/0092152 A1 May 5, 2005

(51) Int. Cl.
*B26D 7/06* (2006.01)

(52) U.S. Cl. ..... 83/13; 83/435.15; 83/436.2

(58) Field of Classification Search ..... 83/437.2, 83/438, 436.2, 435.15, 435.16, 425, 719, 83/437.7, 442; 294/15; 269/315, 303; 144/242.1, 144/253.1, 23.1, 245.1, 245.6, 251.1–251.3; 36/61, 36 R, 67 D See application file for complete search history.

(56) References Cited

U.S. PATENT DOCUMENTS

| | | | | | |
|---|---|---|---|---|---|
| 4,370,909 | A * | 2/1983 | Jennings | 83/436.2 |
| 4,485,711 | A * | 12/1984 | Schnell | 83/425 |
| 4,603,612 | A * | 8/1986 | Atkins | 83/425 |
| 4,897,937 | A * | 2/1990 | Misevich et al. | 36/43 |
| 5,369,895 | A * | 12/1994 | Hammerschmidt | 36/3 A |
| 5,678,467 | A * | 10/1997 | Aigner | 83/436.2 |
| 5,875,827 | A * | 3/1999 | Brutscher et al. | 144/253.1 |
| 6,135,521 | A | 10/2000 | Wirth, Jr. et al. | |
| 6,732,623 | B1 * | 5/2004 | Jennings | 83/436.2 |
| 6,739,075 | B2 * | 5/2004 | Sizemore | 36/61 |

* cited by examiner

*Primary Examiner*—Boyer D. Ashley
*Assistant Examiner*—Phong H Nguyen
(74) *Attorney, Agent, or Firm*—Nixon & Vanderhye PC

(57) ABSTRACT

A push block including a heel that has a stored position and an operative position. Accordingly, when the push block is disposed face down on a flat workpiece and the heel is in its stored position, the push block can effectively perform the functions of a flat face push block. When, on the other hand, the heel is disposed in its operative position and the push block is disposed so that the heel can engage an end edge of the workpiece, the push block can effectively perform the functions of a fixed heel push block.

13 Claims, 7 Drawing Sheets

PUSH BLOCK HAVING RETRACTABLE HEEL

BACKGROUND OF THE INVENTION

The present invention relates to push sticks and push blocks and, more particularly, to a push block having a retractable heel for securely engaging and advancing a workpiece over or through woodworking equipment.

In woodworking operations involving equipment such as table saws, routers, planers, jointers, and the like, a push stick or push block is typically used to advance the workpiece through the equipment and past the cutting tool, to reduce the risk of accidental injuries to the fingers and hands. A push block also helps to control the workpiece, to maintain dimensional tolerances.

There are essentially two varieties of push sticks or blocks currently on the market. The most common one has a flat face for being disposed flat on the surface of the workpiece. The second type has one or more fixed notches or steps (heels) integrated into the push block structure.

There are some woodworking tasks, particularly when working with elongated workpieces, for which both types of push block are desired during a single operation. In such a case, the flat face push block is desirable during initial advancement of the workpiece and feed of the workpiece past the cutter. On the other hand, a push block with a heel is preferred when the trailing end of the workpiece is advanced towards and through the cutting region. In this situation, the operator may be forced to switch push blocks in the middle of a cut or make due with the push block at hand, compromising both safety and control.

SUMMARY OF THE INVENTION

In accordance with an embodiment of the invention, a push block is provided including a heel that has a stored position and an operative position. Accordingly, when the push block is disposed face down on a flat workpiece and the heel is in its stored position, the push block can effectively perform the functions of a flat face push block. When, on the other hand, the heel is disposed in its operative position and the push block is disposed so that the heel can engage an end edge of the workpiece, the push block can effectively perform the functions of a fixed heel push block.

In an exemplary embodiment, the heel is displaced from its operative position to its stored position by disposing the push block on a flat surface and applying downward pressure. In a preferred embodiment, the heel is mounted to the main body of the push block so as to be retractable, most preferably vertically retractable, into the body of the push block, so that when the push block is placed on the workpiece and downward pressure is applied, the heel is displaced into the body, enabling substantially full contact of the working surface of the push block with the workpiece. This full face contact provides a positive grip which allows the operator to control the movement of a large workpiece. Then, when the push block is disposed adjacent the trailing edge of the workpiece, the heel can project downwardly relative to the body of the push block so that it can engage the trailing edge of the workpiece. This will enable the operator to exert sufficient force to power even the toughest wood through virtually any machine, while keeping hands safely away from the cutter(s).

In a preferred embodiment, the heel mechanism is made entirely of plastic material so that there are no metal parts such as springs, fasteners or the like which could cause damage to tooling or injure the operator if struck by cutters.

Thus, the invention is embodied in a push block device for displacing a workpiece relative to woodworking equipment, comprising: a main body having a proximal end, a distal end, a longitudinal axis, and a first, generally flat working surface; a handle component extending from said main body whereby when said first working surface is disposed in parallel facing relation to a top surface of a workpiece, said handle component is disposed predominantly vertically above said main body; and a heel component extending from said main body so as to have a first, operative position, wherein said heel projects vertically below a first plane of said first working surface, and a second, stored position wherein said heel is disposed in or vertically above said first plane, said heel defining a second working surface disposed in a second plane defined at an angle with respect to said first working surface.

In an exemplary embodiment, the heel projects resiliently downwardly below said first plane so that when upward pressure is applied to the heel in a direction generally perpendicular to said first plane, the heel is displaced vertically with respect to said first plane.

According to a further feature of the invention, the heel separately formed and is secured to the main body.

According to yet a further feature of the invention, a heel receiving compartment is defined in the main body so that when the heel is deflected vertically with respect to the first working surface, the heel is received substantially entirely within the main body.

Preferably, at least one slip resistant pad is secured to at least one of the first and second working surfaces, to facilitate frictional engagement with the workpiece.

BRIEF DESCRIPTION OF THE DRAWINGS

These and other objects and advantages of this invention will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
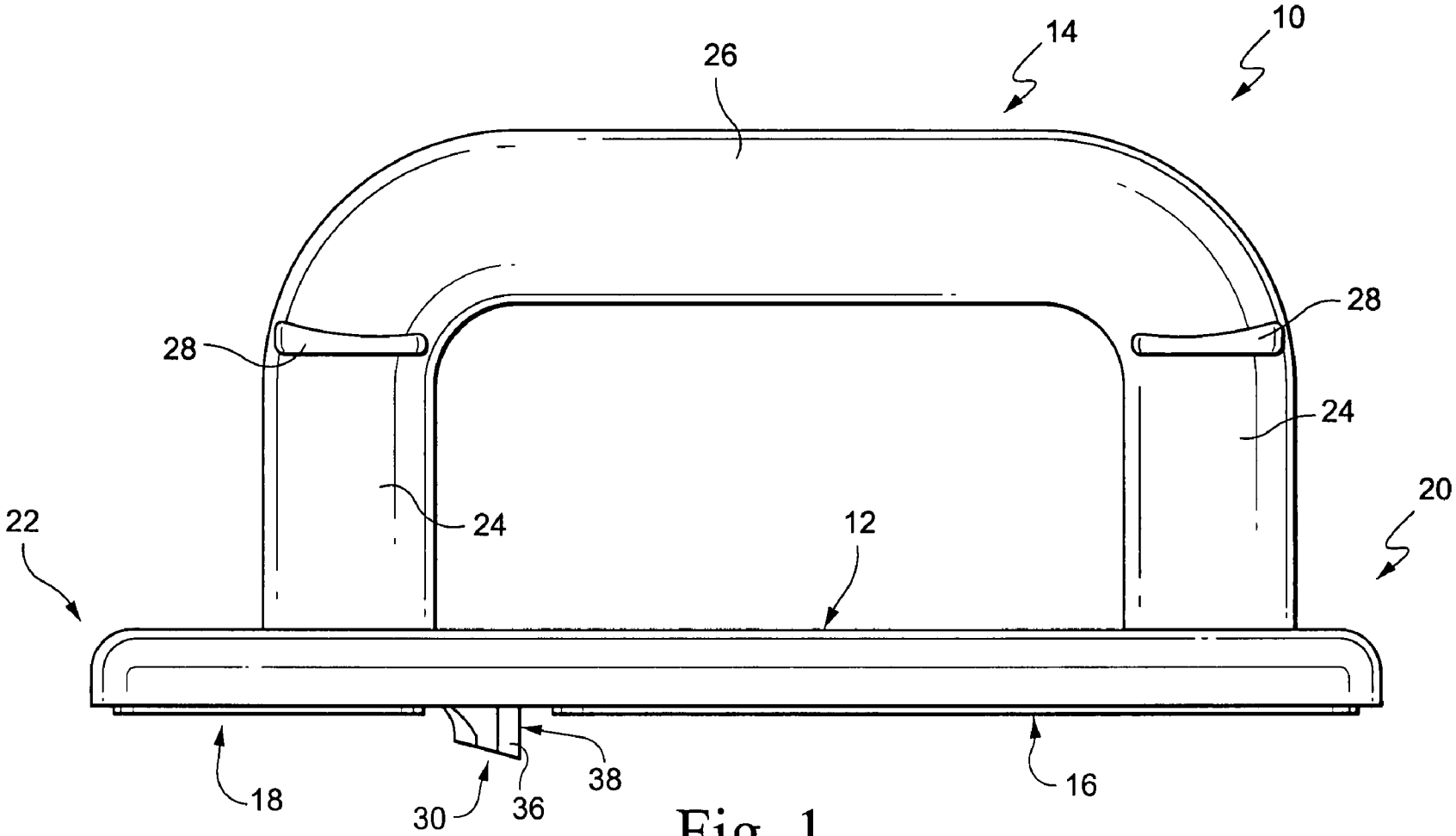
FIG. 1 is a side elevational view of a push block embodying the invention.
Figure 2:
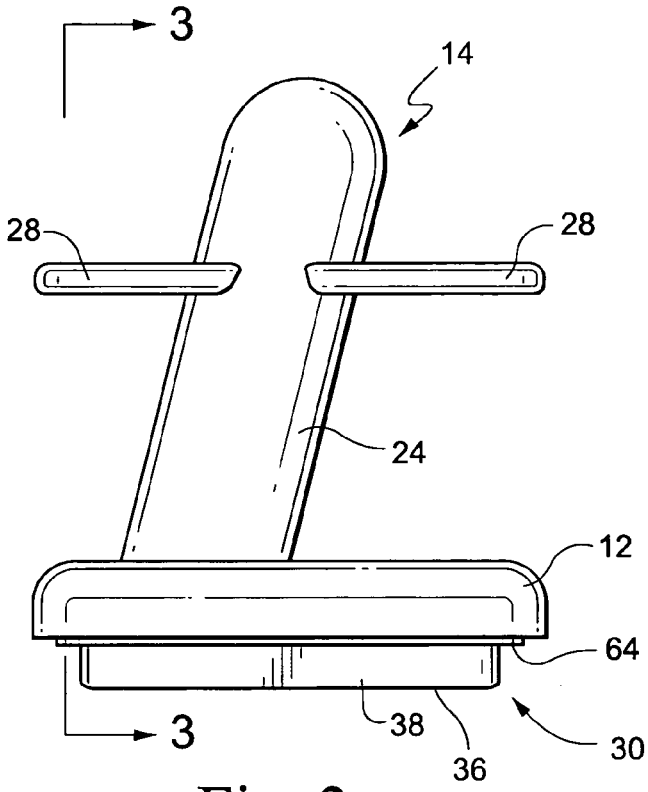
FIG. 2 is a front end elevational view of a push block embodying the invention.

It is one of the objects of the present invention to provide a push block which securely engages a workpiece as it is advanced through a cutting tool, to provide a stabilizing function. In accordance with this object of the invention, push block 10 has a main body 12 having a handle 14 and first working surface(s) 16, 18. In an exemplary embodiment, the first working surface(s) comprise an undersurface of the push block main body that is adapted to face the workpiece upper surface.

The push block has a leading, front or distal end 20; a trailing, rear or proximal end 22; and a longitudinal axis extending the length of the main body. In the illustrated embodiment, the handle 14 is integrally formed with the main body and is generally U-shaped to includes legs 24 and grip 26. It is to be understood that the handle could be separately formed and/or could be another shape and configuration, such as T-shaped or L-shaped. In the illustrated embodiment, the handle is inclined at an angle of less than 90° with respect to the plane of the first working surface(s) 16,18 so as to facilitate viewing of the cutting region of the workpiece and to keep the operator's hand well spaced from any cutting blades.

The push block main body and handle are preferably molded from a co-polymer plastic material whereby the push block is light weight yet durable and corrosion proof. In addition, the use of a co-polymer plastic prevents blade/bit damage should the push block accidentally come into contact with the cutting implement. The co-polymer plastic also prevents the push block from splintering and the attendant risk of having shrapnel thrown back at the operator should the push block accidentally engage the cutting implement. In a presently preferred embodiment, the main body of the device as well as the plate are made from high impact polystyrene (HIPS). Although it is to be understood that these parts could be made from any suitable plastic material.

In the illustrated embodiment, wings or tabs 28 project laterally from the front and rear legs 24 of the push block handle to allow the operator to brace fingers or the heel of the hand in a most comfortable and stable manner during advancement of the workpiece particularly as downward and forward pressure is applied to the workpiece. In the illustrated embodiment, the tabs are slightly scooped or elevated to the front and rear so that pressure can be applied thereto, both downwardly and, e.g., forwardly. It is to be understood that other tab configurations and orientations may be adopted without departing from the invention.

Figure 7:
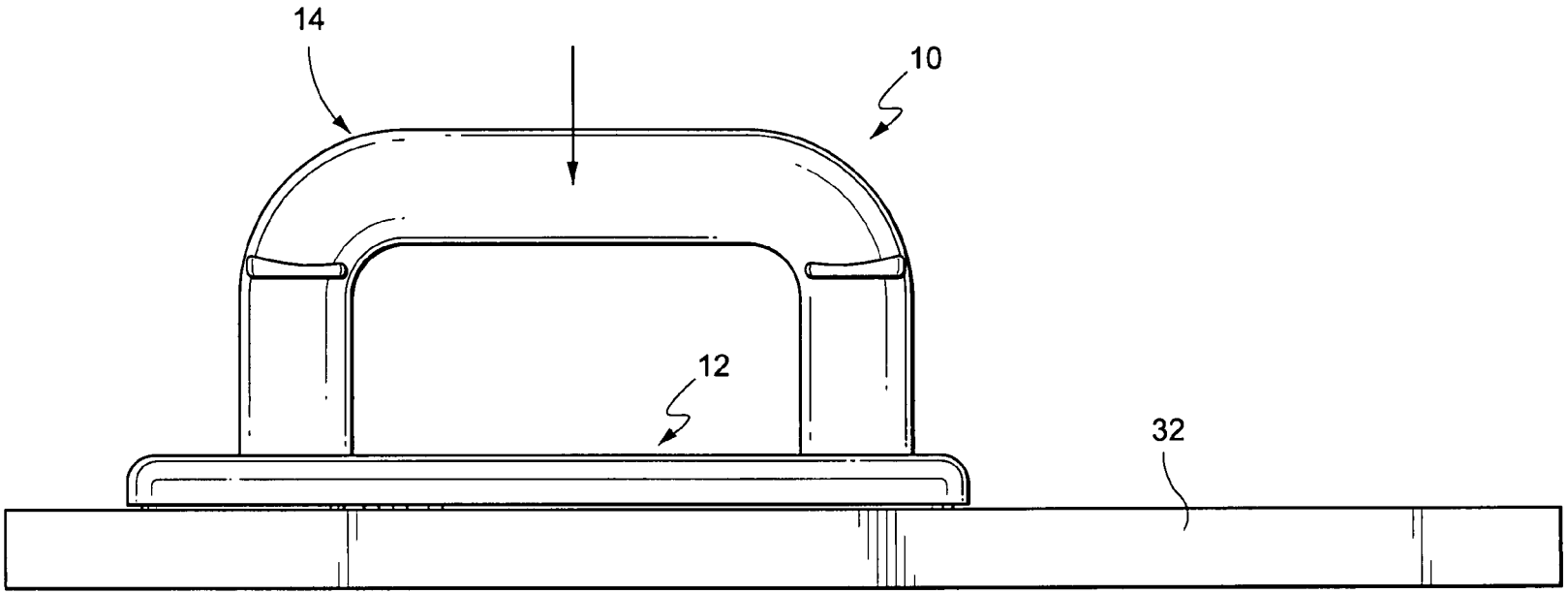
FIG. 7 is a side elevational view of a push block embodying the invention disposed on a workpiece.
Figure 8:
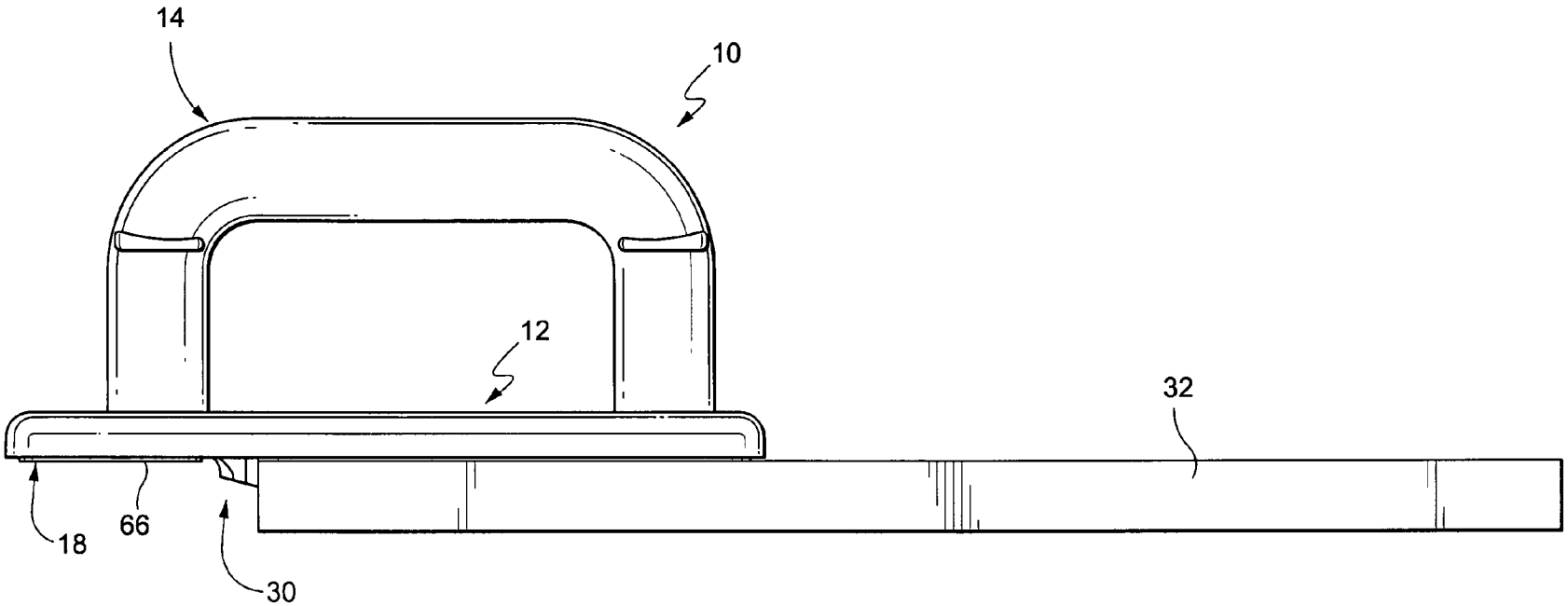
FIG. 8 is an elevational view similar to FIG. 7 showing the push block disposed to over hang a trailing edge of the workpiece.

With reference to FIGS. 1,3,7 and 8, in accordance with the invention, the push block 10 includes a heel 30 that has a stored position (FIG. 7) and an operative position (FIG. 8). Accordingly, when the push block 10 is disposed face down on a flat workpiece 32 and the heel is in its stored position, the push block can effectively perform the functions of a flat face push block (FIG. 7). When, on the other hand, the heel 30 is disposed in its operative position and the push block is disposed so that the heel can engage an end edge of the workpiece 32, the push block can effectively perform the functions of a fixed heel push block (FIG. 8).

In a preferred embodiment, the heel is mounted to the main body 12 of the push block so as to be retractable, most preferably vertically retractable, into the body of the push block. Moreover, in the illustrated embodiment, a cavity or compartment 34 is defined in the main body for selectively receiving the retractable heel. Thus, when the push block is placed on the workpiece and downward pressure is applied, the heel is displaced into the heel receiving compartment 34 defined in the main body 12 enabling substantially full contact of the working surface 16,18 of the push block with the workpiece. This full face contact provides a positive grip which allows the operator to control the movement of a large workpiece. Then, when the push block is disposed over the trailing edge of the workpiece, the heel 30 can project downwardly relative to the body of the push block so that it can engage the trailing edge of the workpiece. This will enable the operator to exert sufficient force to power even the toughest wood through virtually any machine while keeping hands safely away from the cutters.

In the illustrated embodiment, the retractable heel is formed separately from the main body and is secured to the main body. In the alternative, the heel can be molded into the body at the time the body is molded so that the heel is molded as an integral part of the push block body. In a preferred embodiment, the entire heel mechanism is made entirely of plastic material so that there are no metal parts such as springs, fasteners or the like which could cause damage to tooling or injure the operator if struck by cutters.

Thus, the heel 30 is disposed in or above the plane of the main body first working surface(s) 16,18 when the push block is disposed, e.g., with downward (and forward) force on the workpiece as illustrated in FIG. 7, but projects below the plane of the working surface of the push block when the push block is not pushed down on a workpiece and/or when a proximal or rear portion of the push block is disposed to over hang an edge of the workpiece, such as the trailing edge, as shown in FIG. 8. It will be understood that because the heel of the push block moves to a stored position in or above the plane of the working surfaces 16,18 when the operator applies downward pressure, the push block can effectively perform the functions of the two existing push block configurations.

In the illustrated embodiment, the retractable heel 30 is formed to include a workpiece engaging head 36 having a working surface 38 disposed in a second plane defined at an angle with respect to the place of the working surface(s) 16,18 and first and second resilient legs 40,42 to allow displacement of the head with respect to the push block main body. In an exemplary embodiment, the heel structure 30 is asymmetrically configured so that the head 36 is extended one side, e.g., the left side. Although in the illustrated embodiment the heel comprises first and second legs, it is to be understood that the heel could have a geometry with only a single support or leg so that the invention is not to be limited to the illustrated configuration.

Figure 3:
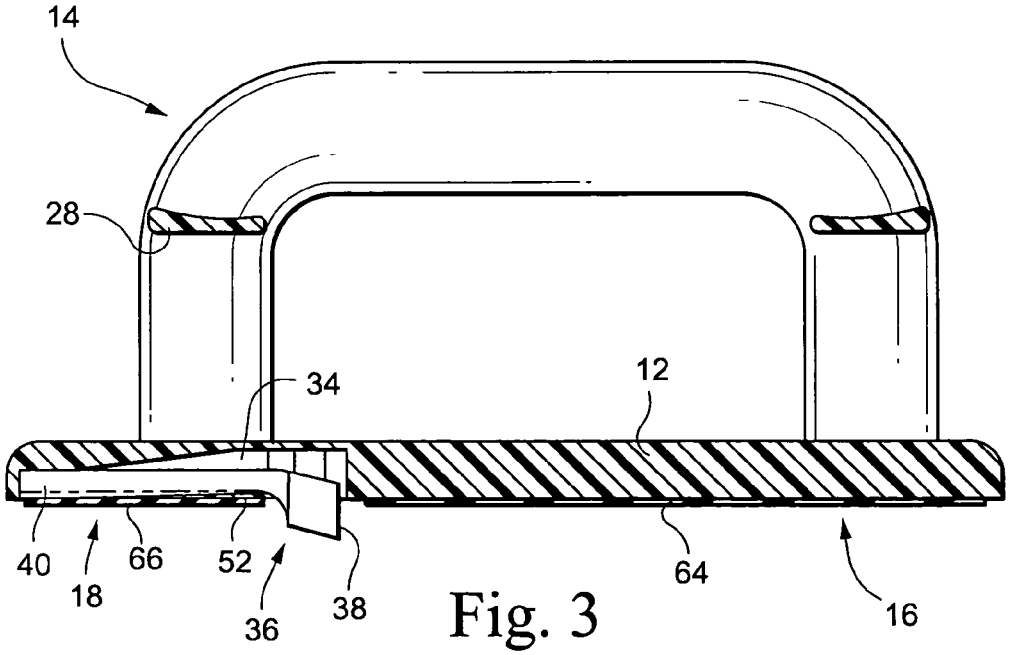
FIG. 3 is a cross-sectional view taken along line 3-3 of FIG. 2.
Figure 4:
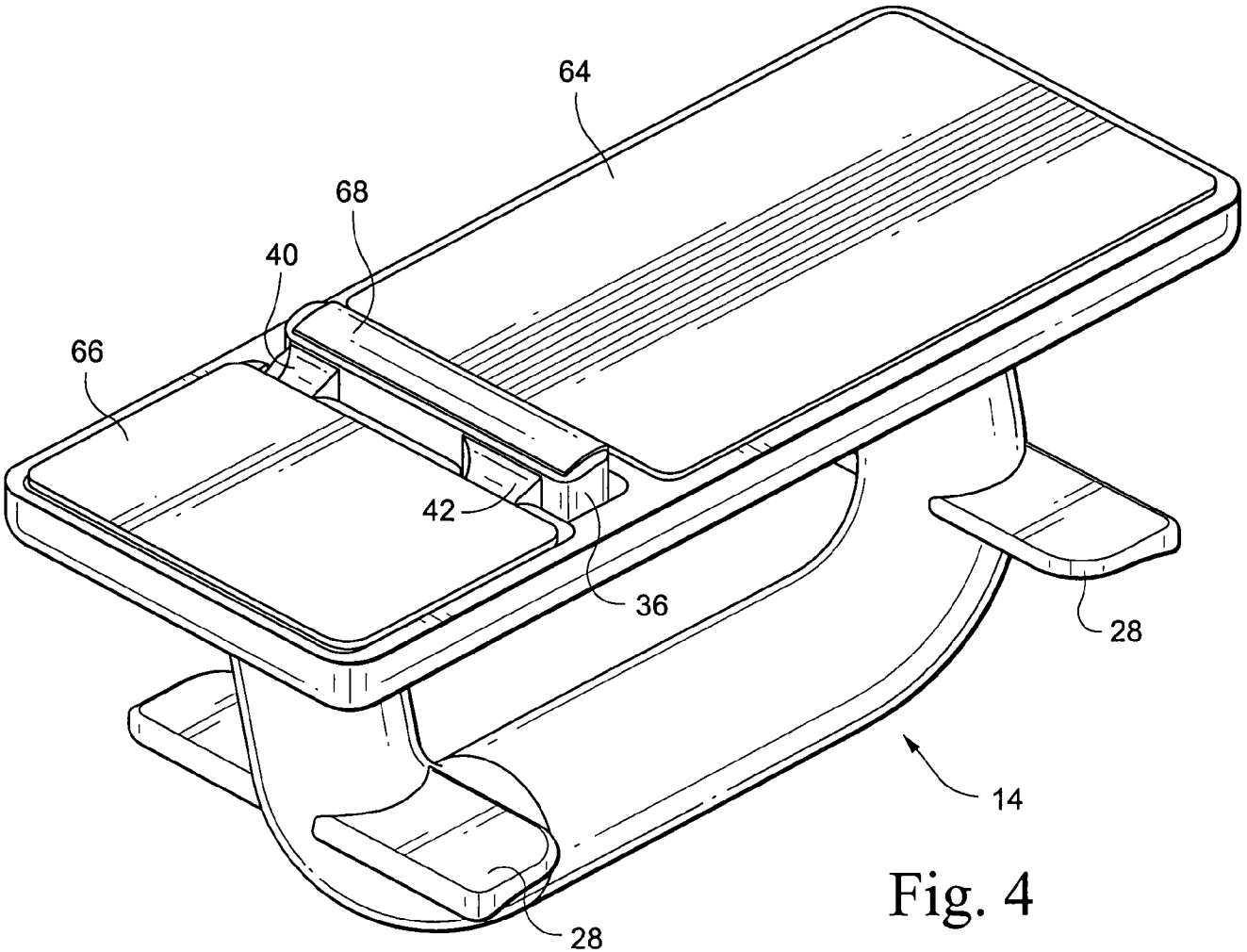
FIG. 4 is a perspective view of a push block embodying the invention from below, rear and left.
Figure 5:
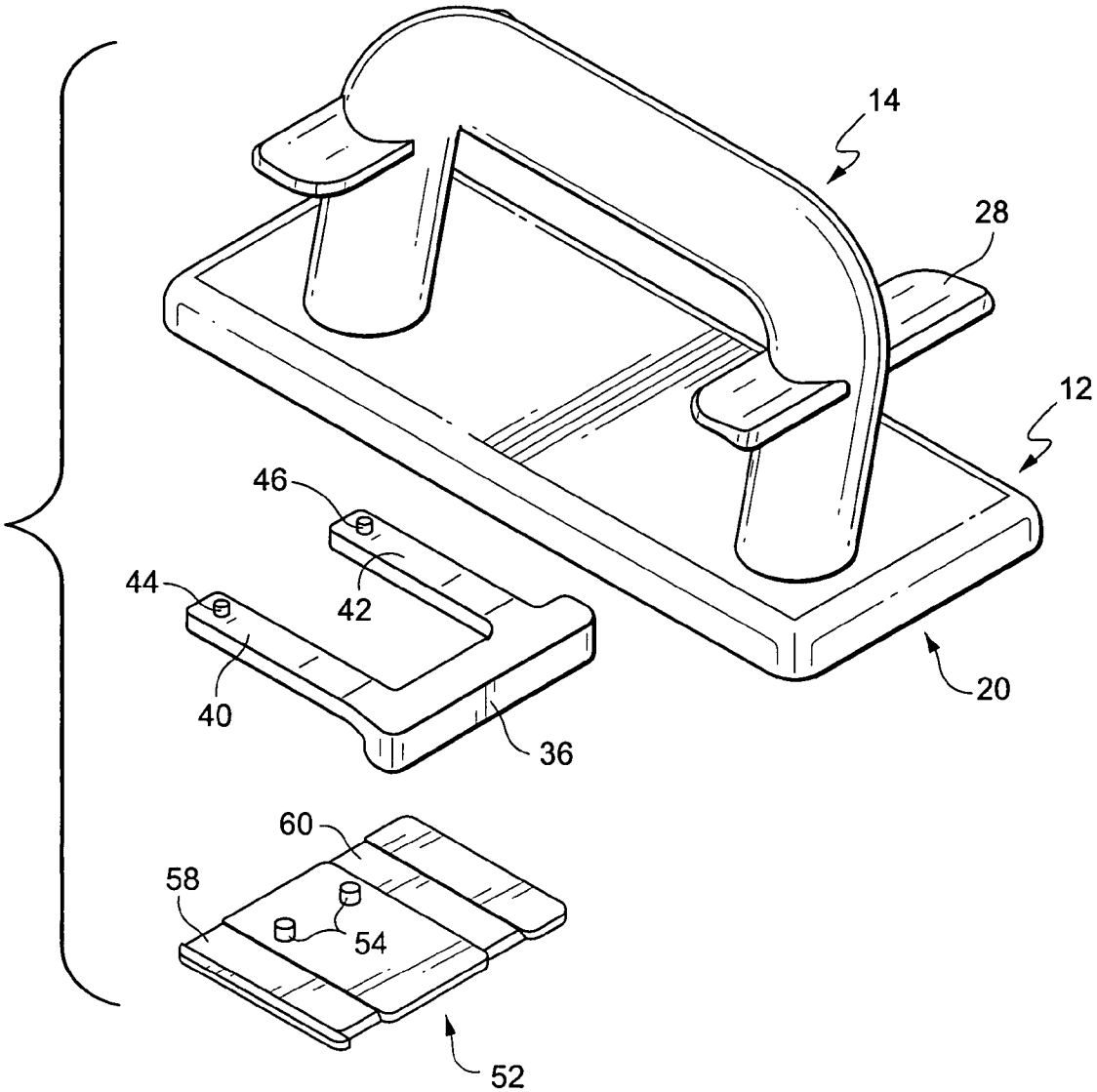
FIG. 5 is an exploded perspective view of a push block embodying the invention taken from above, front and right, omitting the no slip pads of the FIG. 4 embodiment.
Figure 6:
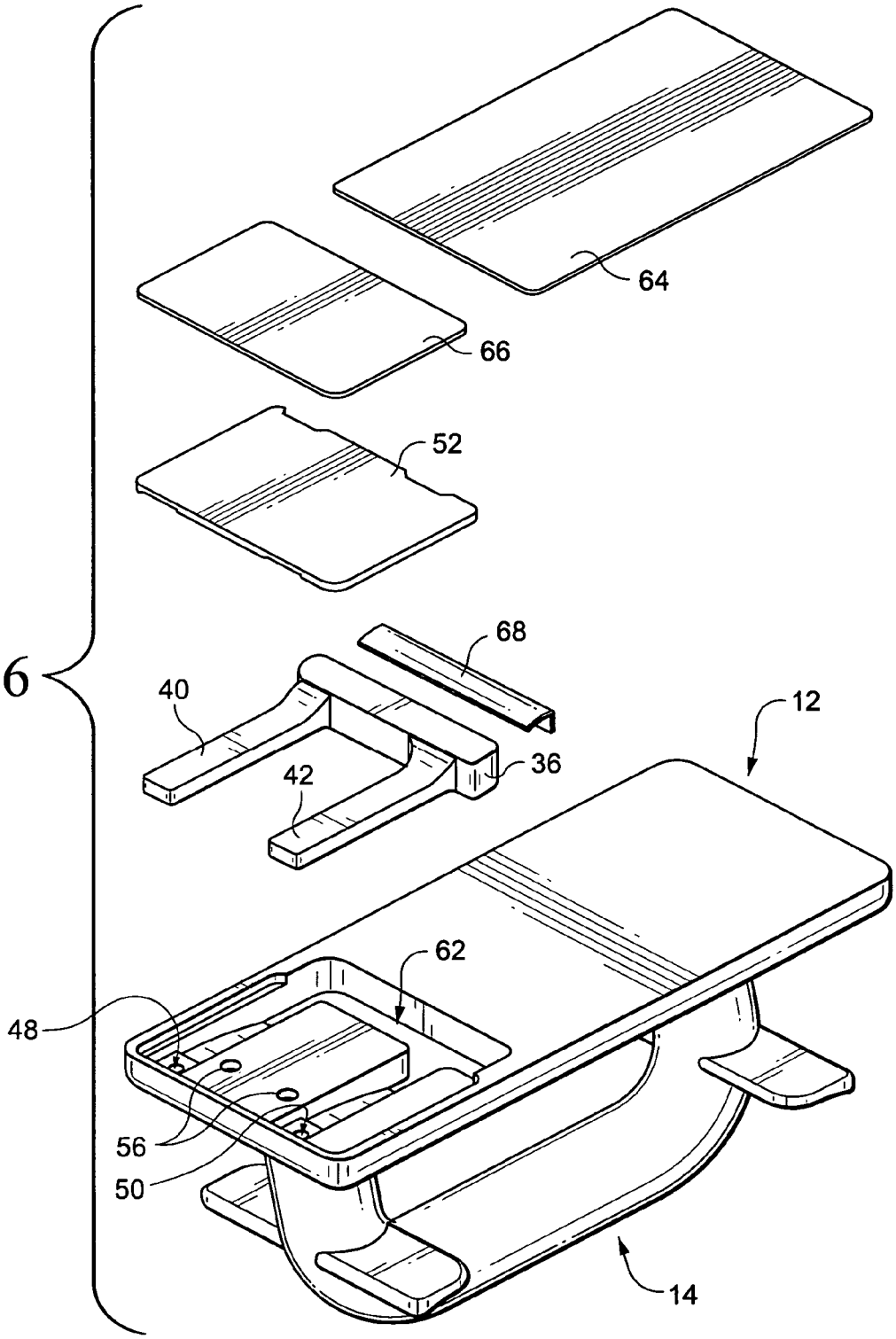
FIG. 6 is an exploded perspective view of the structure shown in FIG. 4.

To secure the retractable heel with respect to the main body, in the illustrated embodiment, first and second attachment pegs 44,46 are defined adjacent the proximal ends of the resilient legs 40,42 for being disposed in corresponding receptacles 48,50 defined in the main body 12. The pegs may be glued in the receptacles if deemed necessary or desirable. Furthermore, the pegs and receptacles could be switched or combined. A plate 52 is further secured to the main body to provide the bottom wall of the heel cavity or compartment 34 in the main body. In an exemplary embodiment, the plate is formed from e.g., the same plastic material as the push block main body 12 and is secured to the main body by engaging correspondingly shaped projections and recesses and preferably securing the same with glue. In the illustrated embodiment, the projections 54 are defined on the plate and are received in correspondingly sized and shaped receptacles 56 in the main body, but those components could be reversed or combined so that a pin and receptacle are provided on each of the parts. In the illustrated embodiment, the plate includes longitudinally extending recesses 58,60 corresponding to the legs 40,42 of the heel 30 and has a length less than the length of the cutout 62 in the main body so that the workpiece engaging head 36 of the heel structure can selectively protrude from the cavity as shown in FIG. 3 or be displaced so as to be disposed within the confines of the cavity as shown in FIG. 7. The plate 52 also ensures that the heel 30 will not undesirably displace rearwardly on engagement with the rear edge of the workpiece and thus also defines a longitudinal limit for the head 36 of the heel.

To augment the gripping of the workpiece by the push block, for increased control and to avoid slip, the working surfaces 16,18,38 of the main body and the retractable heel are optionally but preferably provided with a friction enhancing configuration or material. In the illustrated embodiment, no-slip pads 64,66,68 are provided, attached to the working surfaces of the push stick main body and the head of the retractable heel. The pads are preferably made from a low elastomer plastic, for example, DYNAFLEX G7940 manufactured by the GLS Corporation. Use of a low elastomer plastic is preferred because it will not scratch or otherwise damage the exposed surface of even the softest woods. While in the preferred embodiment, the pads are smooth pads provided full length and full width of the respective working surfaces 16,18,38 of the push block body 12 and retractable heel head 36, it is also possible, although less desirable, to provide discrete pads or strips of the rubbery material on the respective working surface(s) While the friction enhancing material pads may be adhesively secured to the push stick main body, in the presently preferred embodiment, the pads are overmolded to the respective push block parts. When the non-slip rubber material is joined to the bottom of the tool in this way during the molding process, the pads become integral with the tool body and heel so they will not come off like glued on pads, even after prolonged use.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for advancing a workpiece relative to woodworking equipment with a push block comprising:

providing a push block including a main body having a proximal end, a distal end, a longitudinal axis, and a first, generally flat working surface; a handle component extending from said main body whereby when said first working surface is disposed in parallel facing relation to a top surface of a workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface;

engaging a top surface of the workpiece with said first working surface; and advancing said workpiece with said push block at least partway past said woodworking equipment while said woodworking equipment works upon said workpiece, wherein said heel component is resiliently retractable from the first, operative position to the second, stored position upon application of an external force, without demounting the heel component from the main body.

2. A method as in claim 1, further comprising displacing said push block relative to said workpiece so that the push-block overhangs a trailing end of the workpiece, and engaging said trailing end with said second working surface.

3. A push block device for displacing a workpiece relative to woodworking equipment, comprising:

a main body having a proximal end, a distal end, a longitudinal axis, and a first, generally flat working surface for engaging a top surface of a workpiece;

a handle component extending from said main body whereby when said first working surface is disposed in parallel facing relation to the top surface of the workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface; and at least one slip resistant pad secured to at least one of said first and second working surfaces, wherein said heel component is resiliently retractable from the first, operative position to the second, stored position upon application of an external force, without demounting the heel component from the main body.

4. A push block device according to claim 3, wherein said at least one pad is over molded to said at least one working surface.

5. A push block device according to claim 1 for displacing a workpiece relative to woodworking equipment, comprising:

a main body having a proximal end, a distal end, a longitudinal axis, and a first, generally flat working surface for engaging a top surface of a workpiece;

a handle component extending from said main body whereby when said first working surface is disposed in parallel facing relation to the top surface of the workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface, for selectively engaging a trailing end surface of the workpiece for displacing the workpiece, wherein said heel includes a head portion defining said second working surface, and first and second legs, and wherein said heel component is resiliently retractable from the first, operative position to the second, stored position upon application of an external force, without demounting the heel component from the main body.

6. A push block device according to claim 5, wherein said first and second legs are secured to said main body.

7. A push block device according to claim 6, wherein said first and second legs include pins for being disposed in correspondingly sized and shaped receptacles in said main body.

8. A push block device according to claim 7, wherein said pins are glued to said receptacles.

9. A push block device according to claim 1 for displacing a workpiece relative to woodworking equipment, comprising:

a main body having a proximal end, a distal end, a longitudinal axis, and a first, generally flat working surface for engaging a top surface of a workpiece;

a handle component extending from said main body whereby when said first working surface is disposed in parallel facing relation to the top surface of the workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface, for selectively engaging a trailing end surface of the workpiece for displacing the workpiece, further comprising a retention plate for securing said retractable heel to said main body, wherein said heel component is resiliently retractable from the first, operative position to the second, stored position upon application of an external force, without demounting the heel component from the main body.

10. A push block device according to claim 9, further comprising at least one slip resistant pad over molded to said plate.

11. A push block device according to claim 1 for displacing a workpiece relative to woodworking equipment, comprising:

a main body having a proximal end, a distal end, a longitudinal axis, and a first, generally flat working surface for engaging a top surface of a workpiece;

a handle component extending from said main body whereby when said first working surface is disposed in parallel facing relation to the top surface of the workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface, for selectively engaging a trailing end surface of the workpiece for displacing the workpiece, wherein said push block main body and handle are molded from a plastic material, wherein said heel component is resiliently retractable from the first, operative position to the second, stored position upon application of an external force, without demounting the heel component from the main body.

12. A push block device for displacing a workpiece relative to woodworking equipment, comprising:

a main body having a proximal end, a distal end, a longitudinal axis, and a first, generally flat working surface for engaging a top surface of a workpiece;

a handle component extending from said main body whereby when said first working surface is disposed in parallel facing relation to the top surface of the workpiece, said handle component is disposed predominantly vertically above said main body; and a heel component extending from said main body so as to have a first, operative position, wherein said heel projects vertically below a first plane of said first working surface, and a second, stored position wherein a bottom edge of said heel is disposed in or vertically above said first plane, said heel defining a second working surface disposed in a second plane defined at an angle with respect to said first working surface, for selectively engaging a trailing end surface of the workpiece for displacing the workpiece, wherein said handle includes a grip portion spaced from said main body and a leg portion extending from said grip portion to said main body, and wherein said heel component is resiliently retractable from the first, operative position to the second, stored position upon application of an external force, without demounting the heel component from the main body.

13. A push block device according to claim 12, wherein said legs extend from adjacent each longitudinal end of said grip portion to said main body.

* * * * *